US009176434B2

(12) United States Patent
Tanaka

(10) Patent No.: US 9,176,434 B2
(45) Date of Patent: Nov. 3, 2015

(54) CLEANING DEVICE AND IMAGE FORMING APPARATUS

(71) Applicant: FUJI XEROX CO., LTD., Minato-ku, Tokyo (JP)

(72) Inventor: Daisuke Tanaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/470,378

(22) Filed: Aug. 27, 2014

(65) Prior Publication Data

US 2015/0261136 A1 Sep. 17, 2015

(30) Foreign Application Priority Data

Mar. 11, 2014 (JP) ..... 2014-048059

(51) Int. Cl.
*G03G 15/16* (2006.01)
*B08B 1/00* (2006.01)

(52) U.S. Cl.
CPC ..... *G03G 15/161* (2013.01); *B08B 1/005* (2013.01)

(58) Field of Classification Search
USPC ..... 399/91, 98, 99, 101, 107, 110, 111, 399/123, 343, 350
See application file for complete search history.

(56) References Cited

U.S. PATENT DOCUMENTS

2013/0315617 A1* 11/2013 Sugiura et al. ..... 399/101
2014/0072326 A1* 3/2014 Yamaguchi et al. ..... 399/102

FOREIGN PATENT DOCUMENTS

JP 2005-70700 A 3/2005
JP 2005-164675 A 6/2005

* cited by examiner

*Primary Examiner* — Hoan Tran
(74) *Attorney, Agent, or Firm* — Sughrue Mion, PLLC

(57) ABSTRACT

A cleaning device includes a housing, a cleaning member, soft sealing members, and hard sealing members. The housing has an opening opposite an outer circumferential surface of a belt supported by a roller. The cleaning member closes part of the opening, is in contact with the outer circumferential surface at a portion of the belt supported by the roller, and removes toner adhering to the outer circumferential surface. The soft sealing members are formed of soft elastic bodies, have contact portions in contact with the outer circumferential surface and parts of the longitudinal end portions of the cleaning member. The hard sealing members have respective contact portions in contact with the side surfaces and the outer circumferential surface at the end portions of the belt. The hard sealing members are formed of hard elastic bodies harder than the soft elastic bodies.

8 Claims, 10 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2014-048059 filed Mar. 11, 2014.

BACKGROUND

Technical Field

The present invention relates to a cleaning device and an image forming apparatus.

SUMMARY

According to a first aspect of the present invention, a cleaning device includes a housing that has an opening opposite an annular belt, which has an outer circumferential surface, end portions, and side surfaces, and is supported by a roller having axial end portions and rotated in a rotational direction. The opening is opposite the outer circumferential surface of the belt in an axial direction of the belt. The cleaning device also includes a plate-shaped cleaning member that has longitudinal end portions, is attached to the housing so as to close part of the opening, is in contact with, in the axial direction of the belt, the outer circumferential surface at a portion of the belt supported by the roller, and removes toner adhering to the outer circumferential surface of the belt. The cleaning device also includes soft sealing members that are formed of soft elastic bodies and have respective contact portions which are in contact with the outer circumferential surface of the belt and have respective upstream end portions in the rotational direction of the belt. The soft sealing members are secured to the housing so as to be in contact with parts of the respective longitudinal end portions of the cleaning member. The cleaning device also includes hard sealing members that are secured to the housing so that each of the hard sealing members is arranged side by side with a corresponding one of the soft sealing members on a side opposite to the cleaning member relative to the soft sealing member. The hard sealing members have respective contact portions which have upstream end portions in the rotational direction of the belt and are in contact with the side surfaces and the outer circumferential surface at the end portions of the belt, which project outward beyond the axial end portions of the roller. The hard sealing members are formed of hard elastic bodies harder than the soft elastic bodies.

BRIEF DESCRIPTION OF THE DRAWINGS

Exemplary embodiments of the present invention will be described in detail based on the following figures, wherein.

DETAILED DESCRIPTION

Exemplary embodiments of the present invention (simply referred to as "exemplary embodiments" hereafter) will be described below with reference to the accompanying drawings.

First Exemplary Embodiment

Figure 1:
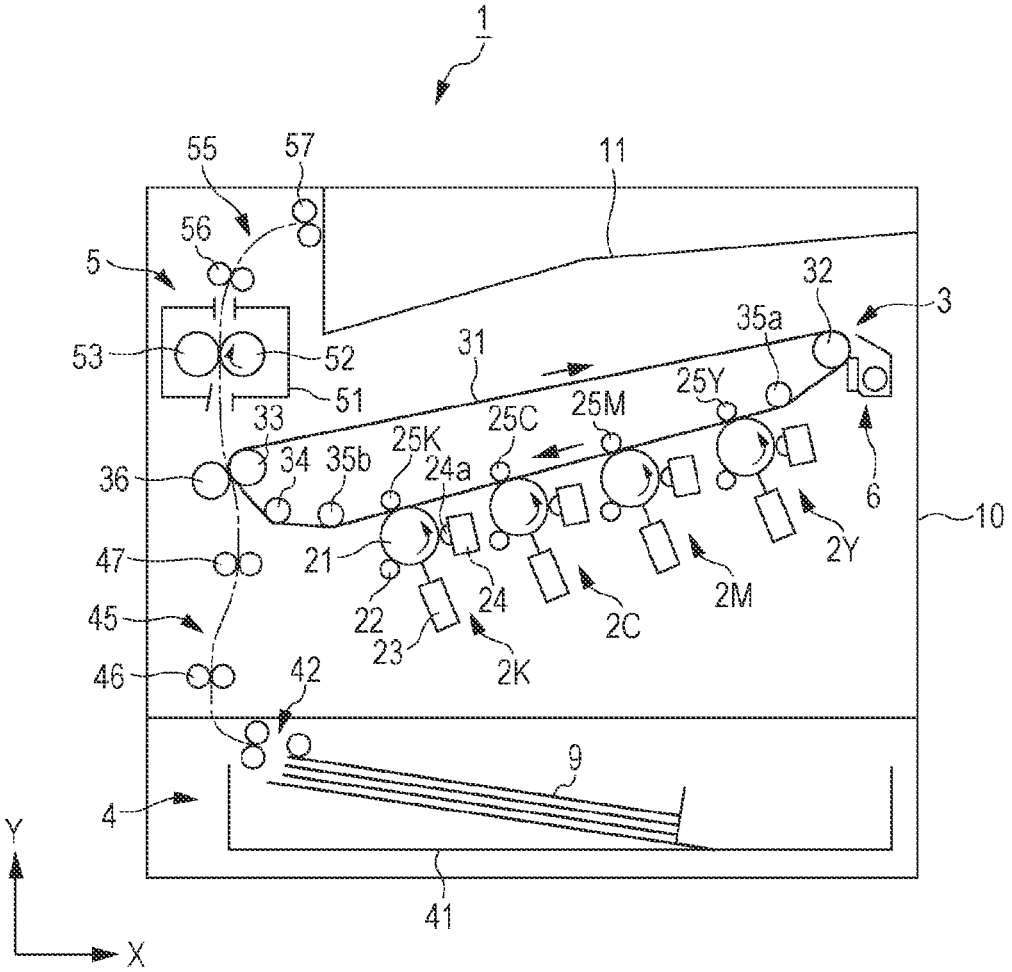
FIG. 1 schematically illustrates a configuration of an image forming apparatus according to a first exemplary embodiment.
Figure 2:
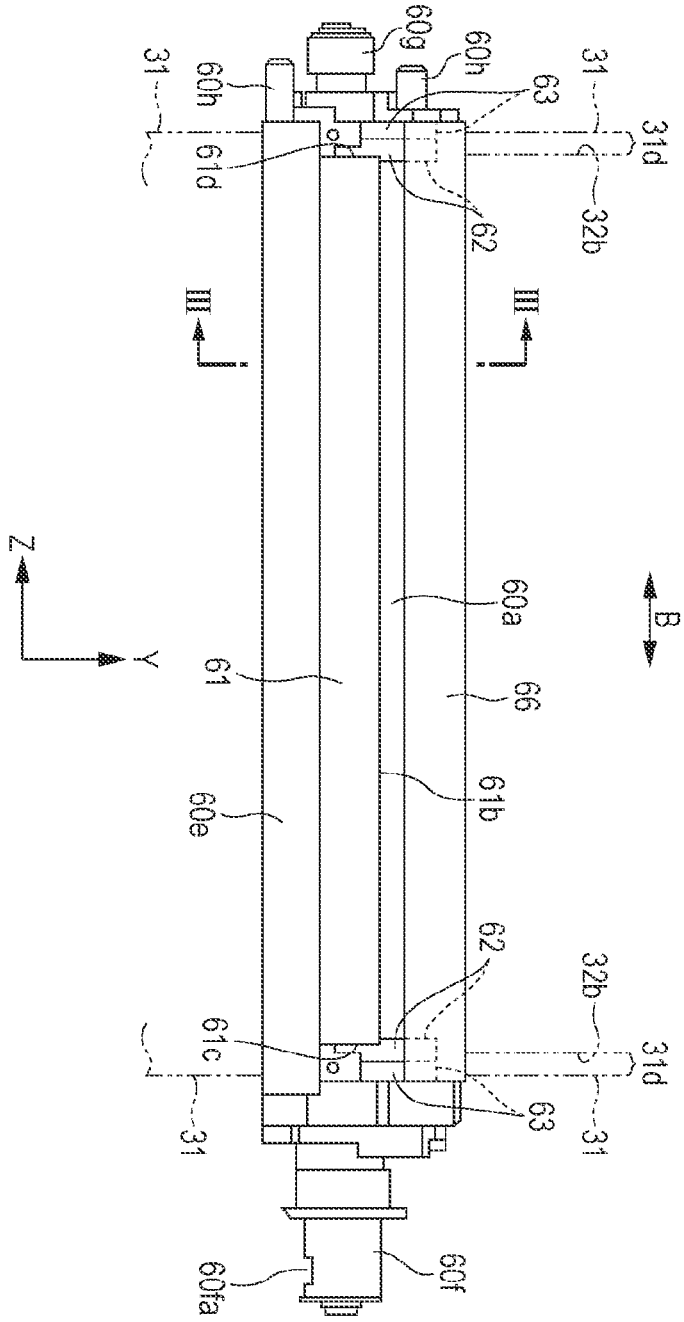
FIG. 2 is a front view illustrating a configuration of a belt cleaning device used in the image forming apparatus illustrated in FIG. 1 when seen from a side where an opening of a housing is provided.
Figure 3:
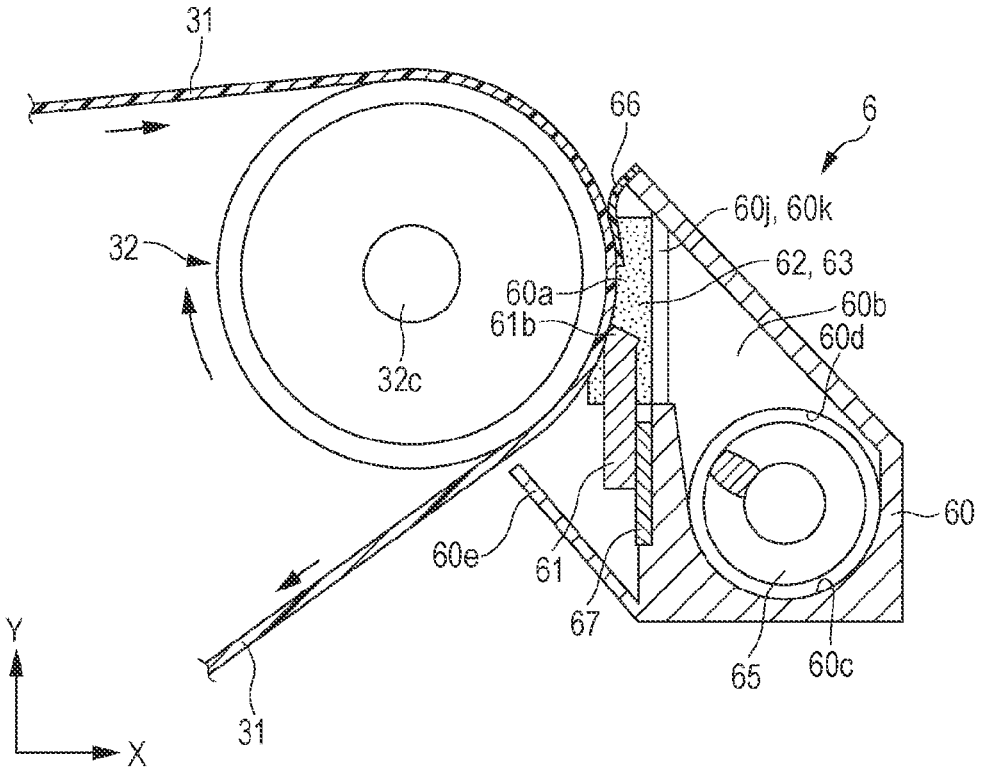
FIG. 3 is a schematic sectional view of the belt cleaning device in use taken along line III-III in FIG. 2.

FIG. 1 schematically illustrates a configuration of an image forming apparatus according to a first exemplary embodiment. FIG. 2 is a belt cleaning device used in the image forming apparatus. FIG. 3 schematically illustrates the belt cleaning device in use. In each of the drawings, arrows denoted by signs X, Y, and Z represent (directions of) the axes of rectangular coordinates that respectively indicate the width, height, and depth directions of a three-dimensional space assumed in the drawing.

An image forming apparatus 1 according to the first exemplary embodiment includes a housing 10 and components thereof including the following components disposed in an internal space of the housing: plural image forming devices 2 that each form a toner image developed with toner serving as developer in accordance with input image information; an intermediate transfer device 3 that holds the toner images formed by the image forming devices 2 and finally transfers the toner images onto a recording sheet 9 serving as a recording medium; a sheet feeder 4 that contains the required recording sheet 9 to be transported to a second transfer position of the intermediate transfer device 3 and feeds the recording sheet 9; and a fixing device 5 that allows the recording sheet 9, onto which the toner images have been transferred by the intermediate transfer device 3, to pass therethrough so as to fix the toner images onto the recording sheet 9. A dot-dash line in FIG. 1 indicates a transport path through which the recording sheet 9 is transported.

The plural image forming devices 2 use four image forming units 2Y, 2M, 2C, and 2K, which each form a corresponding one of four color toner images, that is, yellow (Y), magenta (M), cyan (C), and black (K) toner images. The image forming devices 2 (Y, M, C, and K) are linearly arranged in this order of the four colors in the internal space of the housing 10 such that the image forming devices 2 are spaced apart from one another at required intervals (for example, equal intervals) in a raw inclined downward from the right to the left in FIG. 1. Each of the four image forming units 2 (Y, M, C, and K) includes a photoconductor drum 21, a charger 22, an exposure device 23, a developing device 24, a first transfer device 25, a drum cleaning device (not illustrated), and so forth.

The photoconductor drums 21 each includes a cylindrical or columnar electrically conductive base material, which is grounded, and an image holding surface formed of a photoconductive layer (photosensitive layer) made of an organic photosensitive material and the like on a circumferential surface of the electrically conductive base material. The photoconductor drums 21 are rotated in directions indicated by arrows by power received from a rotational drive device (not illustrated). The chargers 22 each cause the image holding surface of a corresponding one of the photoconductor drums 21 to a required potential. The chargers 22 are contacting chargers that each include a contact member to be in contact with the image holding surface. A charging voltage is applied to the contact member. When the developing device 24 performs, for example, reversal development, the polarity of the charging voltage is the same as the polarity, to which the toner supplied by this developing device 24 is charged.

The exposure devices 23 each radiate light of a corresponding one of separated four-color components in accordance with image information (source) input from the outside of the image forming apparatus 1 toward the charged image holding surface of a corresponding one of photoconductor drums 21. Thus, electrostatic latent images of required latent image potentials are formed. The exposure devices 23 use, for example, non-scanning exposure devices using light emitting diodes, optical components, and so forth. Image signals for latent image formation is input to each of the exposure device 23 from an image processor that performs required processes on image information, which is input from an external device connected to the image forming apparatus such as, for example, a personal computer to the image forming apparatus 1.

The developing device 24 includes a developer container, a developing roller 24*a*, an agitating and transporting member, a layer thickness regulating member, and so forth. The developer container contains a two-component developer (developer containing a non-magnetic toner and magnetic carrier), which is an example of the developer. The developing roller 24*a*, which is disposed near the photoconductor drum 21, holds the developer contained in the developer container and transports the developer to a developing region opposite the developing roller 24*a* while the developing roller 24*a* is rotated. The agitating and transporting member agitates the contained two-component developer and transports the developer to the developing roller 24*a* while the agitating and transporting member is rotated. The layer thickness regulating member regulates the amount (layer thickness) of the developer held by the developing roller 24*a*. Also in the developing device 24, a developing voltage is supplied to the developing roller 24*a*, and the developing roller 24*a* and the agitating and transporting member are rotated in respective required directions by the power received from the rotational drive device (not illustrated). As the developing voltage, for example, a direct current (DC) with which an alternating current (AC) is superposed is supplied. In the developer container, the toner contained in the developer is agitated by the agitating and transporting member. This causes the toner to rub against the carrier. As a result, the toner is triboelectrified to a required polarity (negative polarity in the first embodiment).

The first transfer devices 25 are contacting transfer devices that include contact members. The contact members are each rotated and in contact with the image holding surface, which has undergone a developing process, of a corresponding one of the photoconductor drums 21 (with an intermediate transfer belt 31 nipped therebetween). A first transfer voltage is supplied to the contact members from a first-transfer power feeding unit 16. The contact members are first transfer rollers that press the intermediate transfer belt 31, which will be described later, against the image holding surfaces of the photoconductor drums 21 while the contact members are being driven to rotate. As the first transfer voltage, a DC voltage (a DC voltage, the polarity of which is opposite to the polarity to which the toner is charged) is supplied.

The intermediate transfer device 3 is disposed above the four image forming devices 2 (Y, M, C, and K) in the internal space of the housing 10. The intermediate transfer device 3 includes the intermediate transfer belt 31, plural support rollers 32 to 35, a second transfer roller 36, and a belt cleaning device 6. The intermediate transfer belt 31 passes through first transfer positions formed between the photoconductor drum 21 of each of the image forming devices 2 (Y, M, C, and K) and a corresponding one of the first transfer devices 25 (contact members) while the intermediate transfer belt 31 is rotated in a direction indicated by arrows. The support rollers 32 to 35 rotatably support and hold the intermediate transfer belt 31 in a desired state from an inner surface of the intermediate transfer belt 31. The second transfer roller 36 is in contact with the intermediate transfer belt 31, which is supported by the support roller 33, at a specified pressure and rotated. The belt cleaning device 6 cleans the intermediate transfer belt 31 by removing undesired matter such as toner remaining on and adhering to the intermediate transfer belt 31 after the intermediate transfer belt 31 has passed through the second transfer roller 36.

The intermediate transfer belt 31 uses, for example, an annular belt having a specified thickness and formed by dispersing a resistance adjuster such as carbon in a synthetic resin such as a polyimide resin. Each of the support rollers 32 to 35 serves as follows: the support roller 32 serves as a drive roller; the support roller 33 serves as a backup roller in a second transfer unit; the support roller 34 serves as a tension applying roller that applies a required tension to the intermediate transfer belt 31; and the support rollers 35*a* and 35*b* serve as surface forming rollers used to form a transfer surface. The support roller 32 as the drive roller receives the power from the rotational drive device (not illustrated) and is rotated in a direction indicated by the arrows. A second transfer voltage is supplied to the support roller 33 or the second transfer roller 36. The second transfer voltage, when it is supplied to the support roller 33, is a DC voltage, the polarity of which is the same as the polarity to which the toner is charged. The second transfer voltage, when it is supplied to the second transfer roller 36, is a DC component, the polarity of which is opposite to the polarity to which the toner is charged.

As illustrated in, for example, FIGS. 2 and 3, the belt cleaning device 6 includes a container-shaped housing 60 having a substantially rectangular opening 60*a*. The opening 60*a* opposes an outer circumferential surface of the intermediate transfer belt 31 in the axial direction of the intermediate transfer belt 31 (coordinate axis Z direction in FIG. 2), which is supported by the support roller (drive roller) 32 and rotated. Components such as a cleaning blade 61, sealing members 62, a toner discharge member 65, and a film member 66 are attached to the housing 60. Out of the above-described components, the cleaning blade 61 closes part of the opening 60*a* of the housing 60 (on the long-side side on the downstream side in the rotational direction of the intermediate transfer belt 31). The cleaning blade 61 is in contact with an outer circumferential surface at a portion of the intermediate transfer belt 31, which is supported by the support roller 32, in the axial direction of the intermediate transfer belt 31 so as to remove the toner and the like adhering to the belt outer circumferential surface. The removed toner and the like, for example, fall and are collected in an internal space 60*b* of the housing 60. The sealing members 62 suppress leakage of the toner and so forth contained in the housing 60 to the outside of the housing 60 through both longitudinal end portions (gaps) of the cleaning blade 61. The details of the belt cleaning device 6 will be described later.

The sheet feeder 4 is disposed below the intermediate transfer device 3 in the internal space of the housing 10. The sheet feeder 4 is attached such that the sheet feeder 4 may be drawn toward a front surface of the housing 10 (one of side surfaces the user opposes during operation). The sheet feeder 4 includes a single or plural containers 41, which contain the recording sheets 9 of desired sizes and types stacked one on top of another, and a single or plural feeding devices 42. The feeding devices 42 feed the recording sheets 9 one after another from the containers 41. Reference numeral 45 in FIG. 1 represents a transport path for sheet feeding, through which the recording sheets 9 fed from the sheet feeder 4 is transported to the second transfer position (nip between the intermediate transfer belt 31 and the second transfer roller 36) of the intermediate transfer device 3. The transport path for sheet feeding 45 includes plural transport roller pairs 46, 47, . . . , a transport guide member (not illustrated), and so forth. The transport roller pair 47 is a feed roller pair that has the functions of, for example, correcting transport timing of the recording sheet 9 and a transport state of the recording sheet 9. The above-described feeding device 42, the transport roller pairs, and so forth are rotated in respective required directions by the power received from the rotational drive device (not illustrated; sheet transport system drive unit 49).

The fixing device 5 is disposed in a spatial position above the second transfer roller 36 of the intermediate transfer device 3 in the internal space of the housing 10. The fixing device 5 includes a heat applying rotating body 52 and a pressure applying rotating body 53 disposed in a housing 51. The heat applying rotating body 52 is of, for example, a roller type or a belt type, rotated in a direction indicated by an arrow, and heated by a heating device so that the surface temperature thereof is maintained at a specified temperature. The pressure applying rotating body 53 is of, for example, a roller type or a belt type, in pressure contact with the heat applying rotating body 52 at a specified pressure substantially in the axial direction of the heat applying rotating body 52 so that the pressure applying rotating body 53 is driven to rotate. A required heating voltage is supplied to the heating device of the heat applying rotating body 52. The heat applying rotating body 52 receives the power from the rotational drive device (not illustrated) and is rotated in a required direction. Reference numeral 55 in FIG. 1 is a transport path for sheet ejection, through which the recording sheet 9 having undergone a fixing process is transported so as to be ejected to an ejected sheet container 11. The transport path for sheet ejection 55 includes plural transport roller pairs 56 and 57, a transport guide member (not illustrated), and so forth.

Basic image forming operation performed by the image forming apparatus 1 is described below.

Here, in an example of the image forming operation, a full-color image is formed (full-color mode) by combining toner images of the above-described four colors (Y, M, C, and K).

Initially in image formation in the full-color mode, as illustrated in, for example, FIG. 1, in each of the four image forming devices 2 (Y, M, C, and K), the photoconductor drum 21 is rotated in the direction indicated by the arrow, and the charger 22 charges the image holding surface of the photoconductor drum 21 to the required polarity (negative polarity in the first exemplary embodiment) and potential corresponding to the charging voltage. Next, in each of the image forming devices 2 (Y, M, C, and K), the charged photoconductor drum 21 is exposed to light from the exposure device 23 in accordance with an image signal separated for a corresponding one of the color components (Y, M, C, and K). As a result, an electrostatic latent image of the color component having a specified potential is formed on the image holding surface of the photoconductor drum 21.

Then, development is performed in each of the image forming devices 2 (Y, M, C, and K) as follows: the toner of a corresponding one of the colors (Y, M, C, and K) charged to a specified polarity (negative polarity) is supplied from the developing roller 24*a* of the developing device 24 to part of the photoconductor drum 21 corresponding to the electrostatic latent image for the corresponding color formed on the photoconductor drum 21, thereby causing the toner to be electrostatically attracted to the photoconductor drum 21 by a developing electric field including the developing voltage. Thus, in each of the image forming devices 2 (Y, M, C, and K), the toner image of a corresponding one of the four colors (Y, M, C, and K) is formed on the image holding surface of the photoconductor drum 21. That is, for example, a yellow toner image is formed on the photoconductor drum 21 of the image forming device 2Y, and a magenta toner image is formed on the photoconductor drum 21 of the image forming device 2M.

Then, at the first transfer positions of the image forming devices 2 (Y, M, C, and K), the first transfer devices 25 sequentially (in the order from Y, M, C, to K) transfer the four-color toner images formed on the respective photoconductor drums 21 onto the intermediate transfer belt 31 of the intermediate transfer device 3 through first transfer with the transfer electric field generated by the first transfer voltage. After the above-described first transfer has been performed, outer circumferential surfaces of the photoconductor drums 21 are cleaned by the drum cleaning devices. Next, when the intermediate transfer device 3 rotates the intermediate transfer belt 31 in a direction indicated by the arrows, the toner images, which have been transferred onto the intermediate transfer belt 31 through the first transfer, are transported to the second transfer position. After that, the second transfer roller 36 (or the support roller 33) causes the toner images to be collectively transferred on the recording sheet 9, which has been transported from the sheet feeder 4 through the transport path for sheet feeding 45 through second transfer at the second transfer position with a transfer electric filed generated by the second transfer voltage. After the second transfer has been performed, the outer circumferential surface of the intermediate transfer belt 31 is cleaned by the belt cleaning device 6.

Next, the intermediate transfer device 3 removes the recording sheet 9, onto which the toner images have been transferred through second transfer, from the intermediate transfer belt 31 and then feeds the recording sheet 9 toward the fixing device 5. Next, in the fixing device 5, the recording sheet 9, onto which the toner images have been transferred, is caused to pass through a contact portion, where the heat applying rotating body 52 and the pressure applying rotating body 53 are in contact with each other, so that the recording sheet 9 is subjected to heat and pressure. Thus, the toner images are fused and fixed onto the recording sheet 9. Next, the fixing device 5 feeds the recording sheets 9, onto which the toner images have been fixed, to the transport path for sheet ejection 55. In the case where the image formation operation is performed on one side of the recording sheet 9, the recording sheet 9 having undergone the fixing process is ejected to the outside of the housing 10 through the transport path for sheet ejection 55 and finally contained in the ejected sheet container 11.

Through the above-described operation, one recording sheet 9, on one side of which a full-color image has been formed, is output, and the image forming operation in the full-color mode is completed.

Figure 4:
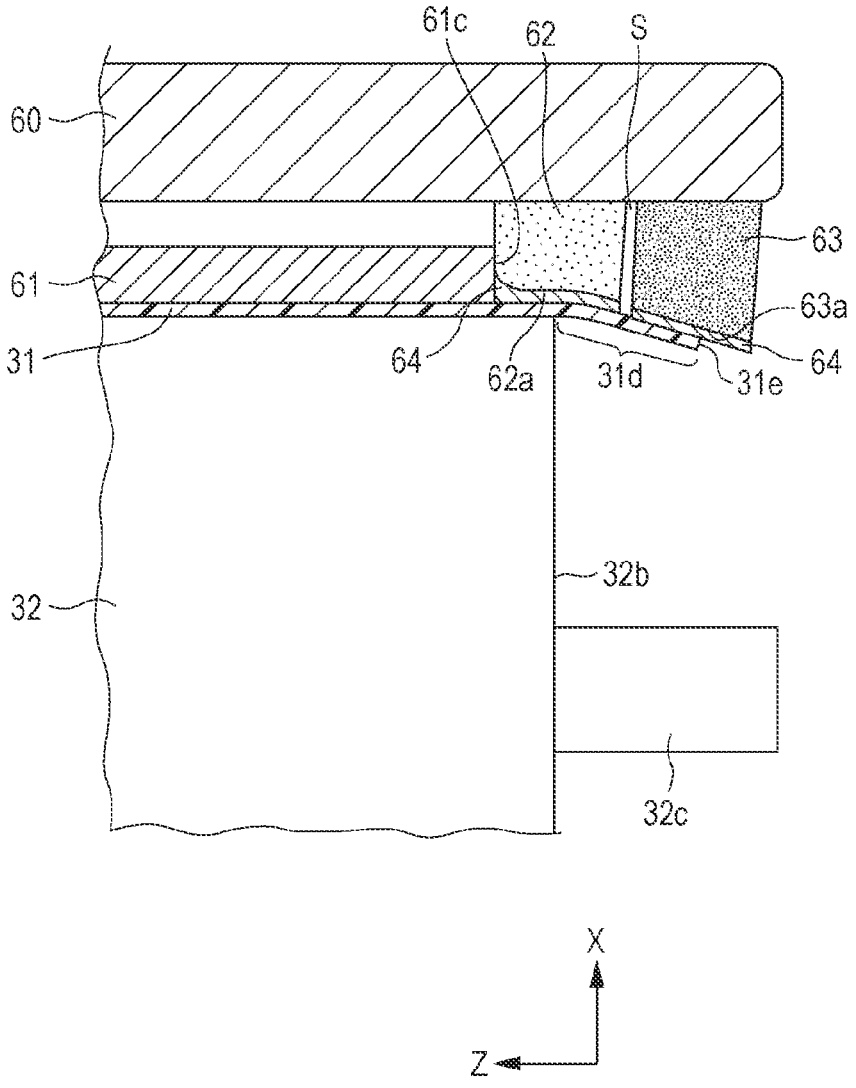
FIG. 4 is a conceptual schematic sectional view illustrating a configuration and a state of a soft sealing member and a hard sealing member of the belt cleaning device in use (attached) illustrated in FIG. 2.

In this image forming apparatus 1, the intermediate transfer belt 31 of the intermediate transfer device 3 has end portions 31*d*, which project outward beyond end portions of the support rollers (such as a drive roller 32) in the axis direction (see, for example, FIG. 4). Undesired matter such as toner may adhere to and accumulate on the outer circumferential surface at the end portions 31*d* and the like of the intermediate transfer belt 31.

Thus, in the present image forming apparatus 1, the belt cleaning device 6 for the intermediate transfer belt 31 uses a cleaning device, with which the adhering matter such as toner adhering to the end portions 31*d* of the intermediate transfer belt 31 may be removed. The cleaning device has the following configuration.

That is, the belt cleaning device 6 according to the first exemplary embodiment includes the soft sealing members 62 and hard sealing members 63 as illustrated in, for example, FIGS. 2 to 4. The soft sealing members 62 are secured to the aforementioned housing 60 while parts of the sealing members 62 are in contact with respective longitudinal end portions 61*c* and 61*d* of the cleaning blade 61. The sealing members 62 have respective contact portions 62*a* to be in contact with the outer circumferential surface of the intermediate transfer belt 31. The hard sealing members 63 are secured to the housing 60 while the hard sealing members 63 are each arranged side by side with a corresponding one of the soft sealing members 62 on a side opposite to the cleaning blade 61 relative to the soft sealing member 62. The hard sealing members 63 have contact portions 63*a* to be in contact with the outer circumferential surface and side surface portions of end portions 31*d* in the intermediate transfer belt 31 that project outward beyond axial end portions 32*b* of the support roller 32. Reference sign 32*c* in, for example, FIGS. 3 and 4 denotes a shaft portion of the support roller 32.

The housing 60 has an elongated container shape that extends in an axial direction B (FIG. 2; the same direction as the direction indicated by the coordinate axis Z) of the intermediate transfer belt 31 (or support roller 32). As illustrated in FIG. 3, the housing 60 has the internal space 60*b*, a semi-cylindrical passage portion 60*c*, and a circular through hole 60*d*. The internal space 60*b* is continuous with the opening 60*a*. A space where the toner discharge member 65 is disposed, the passage portion 60*c* that serves as a path through which the toner is fed, and the through hole 60*d* are provided at a lower bottom portion of the internal space 60*b*. The toner discharge member 65 uses a screw auger or the like having a rotational shaft and a spiral transport blades provided on the rotational shaft. The housing 60 includes a receiving plate 60*e* disposed at a position downstream of the opening 60*a* in the rotational direction of the intermediate transfer belt 31. The receiving plate 60*e* extends so as to approach the outer circumferential surface of the intermediate transfer belt 31 and receives undesired matter if the undesired matter falls from the intermediate transfer belt 31.

Reference sign 60*f* in FIG. 2 denotes a discharge path end portion that contains one end portion of the toner discharge member 65 and has a discharge port 60*fa*. Reference sign 60*g* in FIG. 2 denotes a connecting member secured to the other end portion of the toner discharge member 65 and detachably connected to a drive shaft (not illustrated). Also in FIG. 2, reference sign 60*h* denotes a positioning projection. When the belt cleaning device 6 is pressed into and attach to an attachment portion in the support frame of the intermediate transfer device 3 (or the housing 10 of the image forming apparatus 1), the positioning projection is inserted into a positioning hole (not illustrated) provided on the support frame (or the housing 10) side.

The cleaning blade 61 uses a plate-shaped member formed of an elastic member such as rubber. A lower end portion of the cleaning blade 61, which is a lower long side portion of the cleaning blade 61, is secured to part of the housing 60 with a support plate 67 disposed therebetween. An upper end portion 61*b* of the cleaning blade 61, which is an upper long side portion of the cleaning blade 61, is a free end in contact with the above-described portion of the outer circumferential surface of the intermediate transfer belt 31 in the axial direction B of the intermediate transfer belt 31. The cleaning blade 61 contacts a maximum image forming region, to which the toner images are transferred through the first transfer from the photoconductor drums 21 of the image forming devices 2, of the above-described portion of the outer circumferential surface of the intermediate transfer belt 31.

Figure 5:
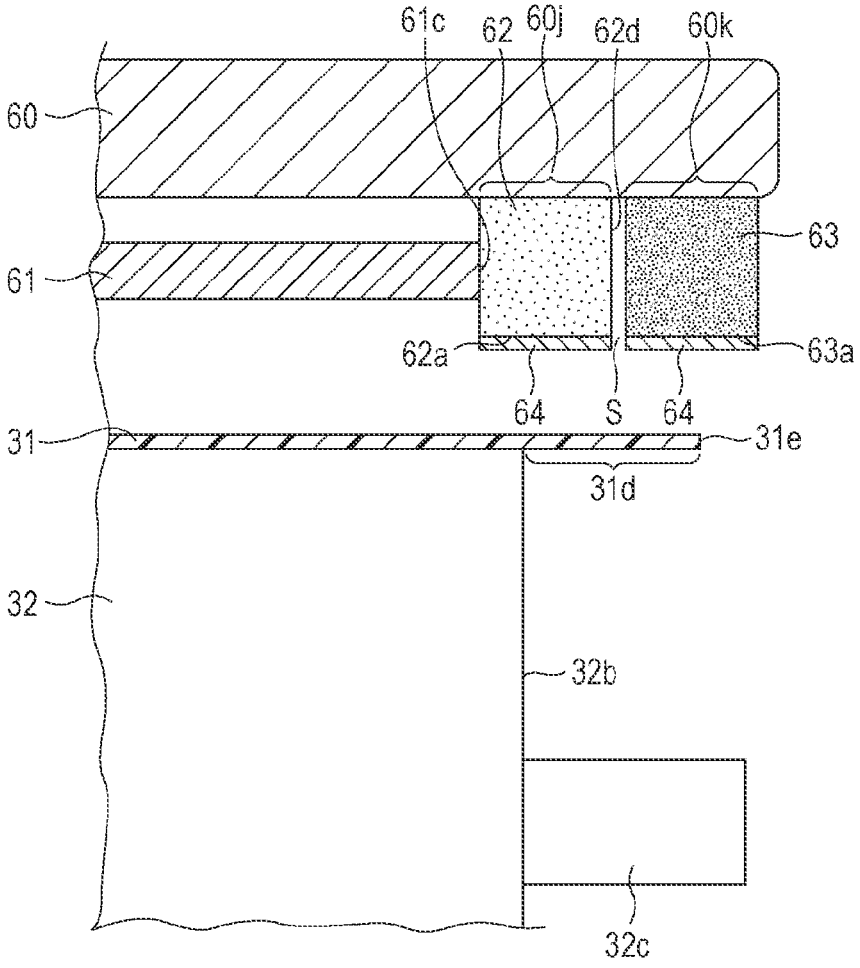
FIG. 5 is a conceptual schematic sectional view illustrating the configuration and the state of the soft sealing member and the hard sealing member when the belt cleaning device illustrated in FIG. 2 is separated from an intermediate transfer belt (detached)
Figure 6A:
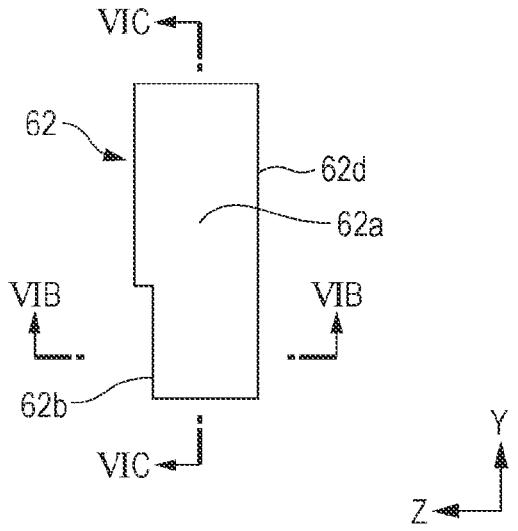
FIG. 6A is a plan view of the soft sealing member when seen from a joining portion.
Figure 6B:
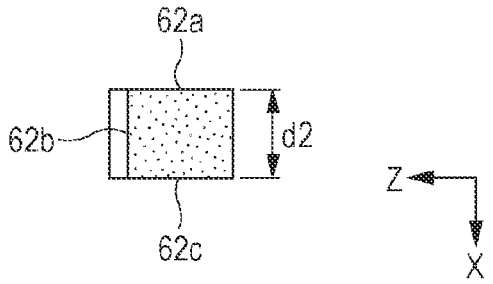
FIG. 6B is a sectional view of the soft sealing member taken along line VIB-VIB in FIG. 6A.
Figure 6C:
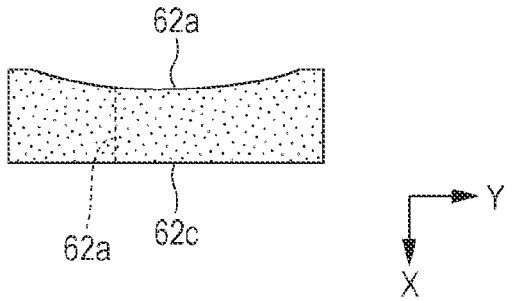
FIG. 6C is a sectional view taken along line VIC-VIC in FIG. 6A.

As illustrated in, for example, FIGS. 5 and 6, in each of the soft sealing members 62, the contact portion 62*a*, which is to be in contact with the outer circumferential surface of the intermediate transfer belt 31, uses a soft elastic body having a required thickness of d2 and a substantially rectangular surface shape elongated in the rotational direction of the intermediate transfer belt 31. In the longitudinal direction of the soft sealing members 62 along the rotational direction of the intermediate transfer belt 31, the contact portions 62*a* of the soft sealing members 62 according to the first exemplary embodiment have a curved surface shape that substantially follows a cylindrical surface of the intermediate transfer belt 31 supported by the support roller 32 (FIG. 6C). Also, the soft sealing members 62 each have a contact surface 62*b* formed by cutting part of a side surface portion thereof (FIGS. 6A and 6C). The contact surfaces 62*b* are in contact with parts of side portions of the respective longitudinal end portions 61*c* and 61*d* of the cleaning blade 61. A soft elastic body of each soft sealing member 62 uses, for example, a soft elastic member such as flexible urethane foam. The thickness d2 of the soft elastic body of the soft sealing member 62 is set to be at least larger than the thickness of the cleaning blade 61.

The soft sealing members 62 have respective securing surfaces 62*c*, which oppose the respective contact portions 62*a* and secured to respective first attachment portions 60*j* of the housing 60 with adhesive layers or the like provided therebetween. When securing the securing surfaces 62*c* to the first attachment portions 60*j*, the soft sealing members 62 are secured so that the contact surfaces 62*b* thereof are brought into tight contact with the respective side portions of the end portions 61*c* and 61*d* of the cleaning blade 61. The soft sealing members 62 are disposed and secured so that the soft sealing members 62 are each to be in contact with the outer circumferential surface at both the following portions of the intermediate transfer belt 31: the portion supported by the support roller 32; and the end portion 31*d* that is not supported by the support roller 32 and projects outward beyond the end portion 32*b* of the support roller 32 (see FIGS. 2 and 4). The first attachment portions 60*j* of the housing 60 face the respective end portions (short side portions) of the opening 60*a* of the housing 60 and have substantially flat attachment surfaces.

Figure 7A:
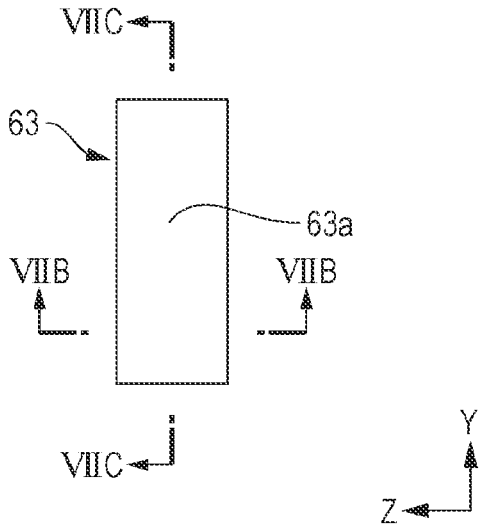
FIG. 7A is a plan view of the hard sealing member when seen from a joining portion.
Figure 7B:
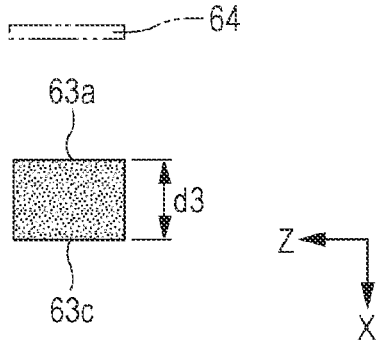
FIG. 7B is a sectional view of the hard sealing member taken along line VIIB-VIIB in FIG. 7A.
Figure 7C:
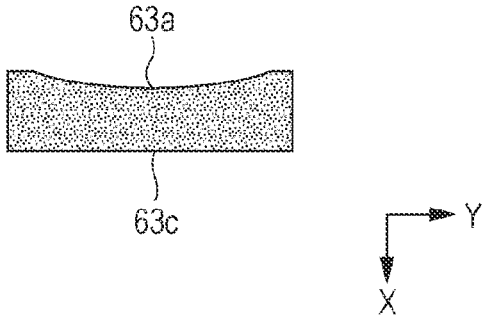
FIG. 7C is a sectional view of the hard sealing member taken along line VIIC-VIIC in FIG. 7A.

As illustrated in, for example, FIGS. 5 and 7, in each of the hard sealing members 63, the contact portion 63*a*, which is to be in contact with portions such as the outer circumferential surface at the above-described portions of the intermediate transfer belt 31, uses a hard elastic body having a required thickness of d3 and a substantially rectangular surface shape elongated in the rotational direction of the intermediate transfer belt 31. In the longitudinal direction of the hard sealing members 63 along the rotational direction of the intermediate transfer belt 31, the contact portions 63*a* of the hard sealing members 63 according to the first exemplary embodiment have a curved surface shape that substantially follows the cylindrical surface of the intermediate transfer belt 31 supported by the support roller 32 (FIG. 7C). The hard elastic body is an elastic member exhibiting a physical property harder than that of the soft elastic body of the soft sealing member 62 and softer than that of the intermediate transfer belt 31. Here, the hardnesses of the elastic bodies are compared by using hardness values (N) measured, for example, in accordance with a measuring method specified in Japanese Industrial Standards (JIS), more specifically, in JIS K 6400-2 as indices. Such a hard elastic body uses an elastic member such as, for example, ester urethane foam (Everlight STXE by Bridgestone Diversified Chemical Products Co., Ltd, (compression: 1/2)) or rigid urethane foam (PORON LE-20 by Inoac Corporation). The thickness d3 of the hard elastic body of the hard sealing member 63 is set to be at least larger than the thickness of the cleaning blade 61. In the first exemplary embodiment, the thickness d3 is set to be substantially the same as the thickness d2 of the soft sealing member 62 at a stage before the hard sealing member 63 is brought into contact with the outer circumferential surface of the intermediate transfer belt 31 (FIG. 5).

The hard sealing members 63 have respective securing surfaces 63*c*, which oppose the respective contact portions 63*a* and secured to respective second attachment portions 60*k* of the housing 60 with adhesive layers or the like provided therebetween. When the hard sealing members 63 are secured to the housing 60, the hard sealing members 63 are secured to such positions that at least part of each of the contact portions 63*a* thereof may be in contact with the outer circumferential surface at a corresponding one of the end portions 31*d* of the intermediate transfer belt 31 during cleaning (see FIGS. 2 and 4). The hard sealing members 63 are each separated from a side surface 62*d* of the soft sealing member 62, which is on a side opposite a side surface that opposes the cleaning blade 61, by a required gap S (for example, FIG. 5). The second attachment portions 60*k* of the housing 60 are each disposed on a side opposite to the opening 60*a* relative to the first attachment portion 60*j* in the housing 60 and, similarly to the first attachment portion 60*j*, have a substantially flat attachment surface. The above-described gap S is set to, for example, from 0.5 to 2 mm.

Furthermore, in the belt cleaning device 6, as illustrated in, for example, FIG. 5, cleaning assist layers 64 are separately provided on the contact portions 62*a* of the soft sealing members 62 and the contact portions 63*a* of the hard sealing members 63. The cleaning assist layers 64 assist in toner capturing (performance) during cleaning. The cleaning assist layers 64 use a material such as, for example, a napped member such as non-woven fabric or wool, or cloth (fiber). The cleaning assist layers 64 are secured to the contact portions 62*a* and 63*a* of the sealing members 62 and 63 with, for example, adhesive layers provided therebetween. In the first exemplary embodiment, the cleaning assist layers 64 are separately provided on the contact portions 62*a* and 63*a* of the sealing members 62 and 63 so that the above-described gaps S set between the sealing members 62 and 63 are not closed (opened) by the cleaning assist layers 64.

The film member 66 is secured at a position of the housing 60 upstream of the opening 60*a* in the rotational direction of the intermediate transfer belt 31. The film member 66 is attached so that the free end thereof covers end portions of the sealing members 62 on the upstream side in the rotational direction of the intermediate transfer belt 31 and part of the opening 60*a* (region of the long side portion on the upstream side in the rotational direction of the intermediate transfer belt 31). A required gap (a space through which toner scraped off by the cleaning blade 61 is moved into the housing 60) is set between a free end 66*a* of the film member 66 and the upper end portion 61*b* of the cleaning blade 61 (FIG. 2). The film member 66 uses a flexible film or a film exhibiting high sliding performance formed of a synthetic resin such as polyethylene terephthalate.

The belt cleaning device 6 having the above-described configuration is in the following state when the belt cleaning device 6 is attached to the attachment portion of the intermediate transfer device 3 with the opening 60*a* of the housing 60 opposing the outer circumferential surface of the intermediate transfer belt 31.

That is, at this time, the belt cleaning device 6 is, as illustrated in, for example, FIGS. 3 to 5, in the following state: the upper end portion 61*b* of the cleaning blade 61 is in pressure contact with the outer circumferential surface at the portion of the intermediate transfer belt 31 supported by the support roller 32 at a required pressure (actually the amount of pushing) in the axial direction B; the soft sealing members 62 are compressed and deformed while the contact portions 62*a* thereof are in contact with the outer circumferential surface at the end portions 31*d* and the portion of the intermediate transfer belt 31 supported by the support roller 32 outside the longitudinal end portions 61*c* and 61*d* of the cleaning blade 61; and the hard sealing members 63 are compressed and deformed while parts of the contact portions 63*a* of the hard sealing members 63 are in contact with the portions such as the outer circumferential surface at the end portions 31*d* of the intermediate transfer belt 31. Furthermore, the film member 66 extends from the position of the housing 60 on the upstream side in the rotational direction of the intermediate transfer belt 31 and is surrounded by the upstream end portions of the soft sealing members 62 and the hard sealing members 63, the upstream end portions being in the rotational direction of the intermediate transfer belt 31, part of the opening 60*a* at the end portion on the upstream side in the above-described rotational direction, and the outer circumferential surface of the intermediate transfer belt 31.

At this time, the end portions 31*d* of the intermediate transfer belt 31 are elastically pushed by the elastically deformable soft sealing members 62 and the hard sealing members 63. Thus, the end portions 31*d* are slightly bent to the inner circumferential surface side of the intermediate transfer belt 31 so as to have an embowed shape. Since the intermediate transfer belt 31 is harder than the hard elastic bodies of the hard sealing members 63 (and applied with a required tension), the hard sealing members 63 are slightly elastically deformed.

In the belt cleaning device 6, when the intermediate transfer belt 31 is rotated in the direction indicated by the arrows, the toner and the like adhering to and remaining on the outer circumferential surface of (the image forming region of) the intermediate transfer belt 31 are scraped off by the upper end portion 61*b* of the cleaning blade 61. The toner and the like having been scraped off drop into and are received by the internal space 60*b* of the housing 60. Thus, the intermediate transfer belt 31 is cleaned by the belt cleaning device 6. The toner and the like having dropped into the internal space 60*b* of the housing 60 during the cleaning are discharged to a toner collecting unit (not illustrated) through the passage portion 60*c* of the housing 60 by the rotating toner discharge member 65.

In so doing, the contact portions 62*a* of the soft sealing members 62 are in contact with the outer circumferential surface of the intermediate transfer belt 31, and the contact surfaces 62*b* of the soft sealing members 62 are maintained in a state in which the contact surfaces 62*b* are pressed against and in tight contact with the side portions of the longitudinal end portions 61*c* and 61*d* of the cleaning blade 61. Thus, the soft sealing members 62 may suppress leakage of the toner and the like in the internal space 60*b* of the housing 60 from both the end portions 61*c* and 61*d* of the cleaning blade 61 to the outside of the housing 60 without forming unnecessary gaps between the soft sealing members 62 and the both the end portions of the cleaning blade 61. Furthermore, the cleaning assist layers 64 of the soft sealing members 62 may capture the toner and the like adhering to the outer circumferential surface of the intermediate transfer belt 31, which is in contact with the contact portions 62*a* through the cleaning assist layers 64.

Also, in so doing, the hard sealing members 63 are maintained in a state in which the contact portions 63*a* thereof are in contact with the outer circumferential surface and side surfaces 31*e* at the end portions 31*d* of the intermediate transfer belt 31 through the cleaning assist layers 64 (FIG. 4). Thus, the hard sealing members 63 may remove the toner and the like adhering to the outer circumferential surface and the side surfaces 31*e* in the end portions 31*d* of the intermediate transfer belt 31. Furthermore, in the hard sealing members 63, the cleaning assist layers 64 provided on the contact portions 63*a* tend to be bent toward the side surfaces 31*e* of the end portions 31*d* of the intermediate transfer belt 31. As a result, the toner and the like adhering to the side surfaces 31*e* of the belt end portions 31*d* may be removed.

In the image forming apparatus 1 that uses the belt cleaning device 6, the toner and the like adhering to the end portions 31*d* of the intermediate transfer belt 31 are removed by the belt cleaning device 6. This may suppress the dropping of the toner adhering to (accumulating on) the belt end portions 31*d* into the housing 10 of the image forming apparatus 1. As a result, the above-described problems due to the dropping of the toner may be suppressed.

Furthermore, as illustrated in, for example, FIG. 4, in the image forming apparatus 1, the soft sealing members 62 of the belt cleaning device 6 are each in contact with the outer circumferential surface at both the following portions of the intermediate transfer belt 31: the portion supported by the support roller 32; and the end portion 31*d* that is not supported by the support roller 32 and projects outward beyond the axial end portion 32*b* of the support roller 32 (see FIGS. 2 and 4). Thus, the intermediate transfer belt 31 is not strongly pressed against the axial end portions 32*b* of the support roller 32. As a result, damage to or breakage of portions of the intermediate transfer belt 31 where the intermediate transfer belt 31 is in contact with the axial end portions 32*b* of the support roller 32 may be suppressed.

Furthermore, as illustrated in, for example, FIG. 4, in the image forming apparatus 1, the hard sealing members 63 of the belt cleaning device 6 are each spaced apart from a corresponding one of (the side surface 62*d* of) the soft sealing members 62 by the required gap S. Thus, the toner and the like removed and captured from each of the end portions 31*d* of the intermediate transfer belt 31 by the contact portion 63*a* and the cleaning assist layer 64 of a corresponding one of the hard sealing members 63 may be pushed into and received by the gap S. Accordingly, the performance of the hard sealing members 63 for removing the toner and the like may be maintained for a long time, and a situation, in which the toner and the like removed by the hard sealing members 63 excessively accumulate and leave, may be suppressed.

In addition, when attachment of the belt cleaning device 6 is performed such that the belt cleaning device 6 is pushed into the intermediate transfer device 3 in the axial direction B of the intermediate transfer belt 31 with one end side in the longitudinal direction of the cleaning blade 61 (end portion side where the positioning projection 60*h* for insertion is provided) first, the attachment operation is facilitated as follows.

That is, in the above described configuration for attachment, when the belt cleaning device 6 is pushed into the intermediate transfer device 3, at an end portion of the belt cleaning device 6 on the downstream side in the pushing direction, the belt cleaning device 6 advances while the hard sealing member 63 and the soft sealing member 62 are brought into contact in this order with the outer circumferential surface at the portion of the intermediate transfer belt 31 supported by the support roller 32 and compressed and deformed. At this time, since the hard sealing member 63 is unlikely to be elastically deformed compared to the soft sealing member 62, the hard sealing member 63 is caught by the intermediate transfer belt 31 when the hard sealing member 63 is brought into contact with the corresponding portion of the outer circumferential surface of the intermediate transfer belt 31, thereby decreasing the smoothness with which the pushing operation is performed.

In the present belt cleaning device 6, the end portions of the soft sealing members 62 and the hard sealing members 63, the end portions being at substantially ends in the belt rotational direction, are continuously covered with the film member 66. Thus, during the pressing operation, the film member 66 is interposed between the corresponding portion of the outer circumferential surface of the intermediate transfer belt 31 and the hard sealing member 63. This reduces the likelihood of the hard sealing member 63 being caught by the intermediate transfer belt 31 when the hard sealing member 63 is brought into contact with the corresponding portion of the outer circumferential surface of the intermediate transfer belt 31. Thus, the hard sealing member 63 may be smoothly elastically deformed, and accordingly, the pressing operation may be smoothly performed.

Other Exemplary Embodiments

Figure 8:
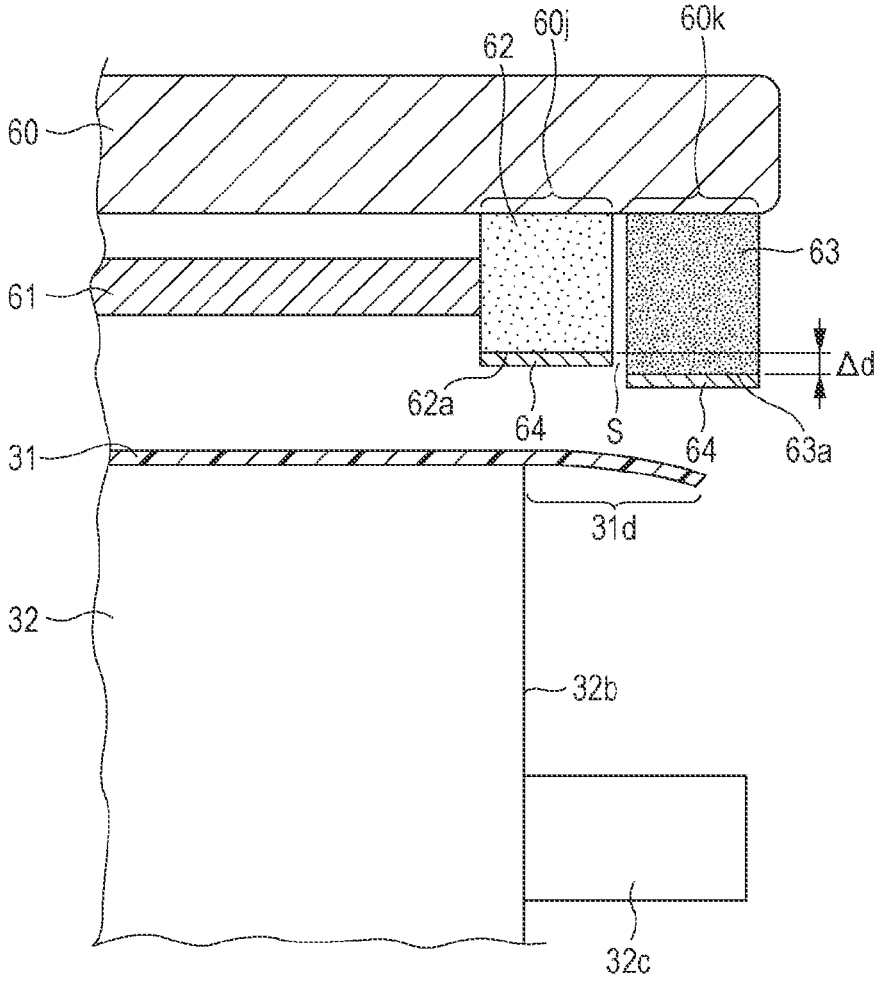
FIG. 8 is a conceptual schematic sectional view illustrating another example of a configuration of the hard sealing member when the belt cleaning device is separated from the intermediate transfer belt (detached)
Figure 9:
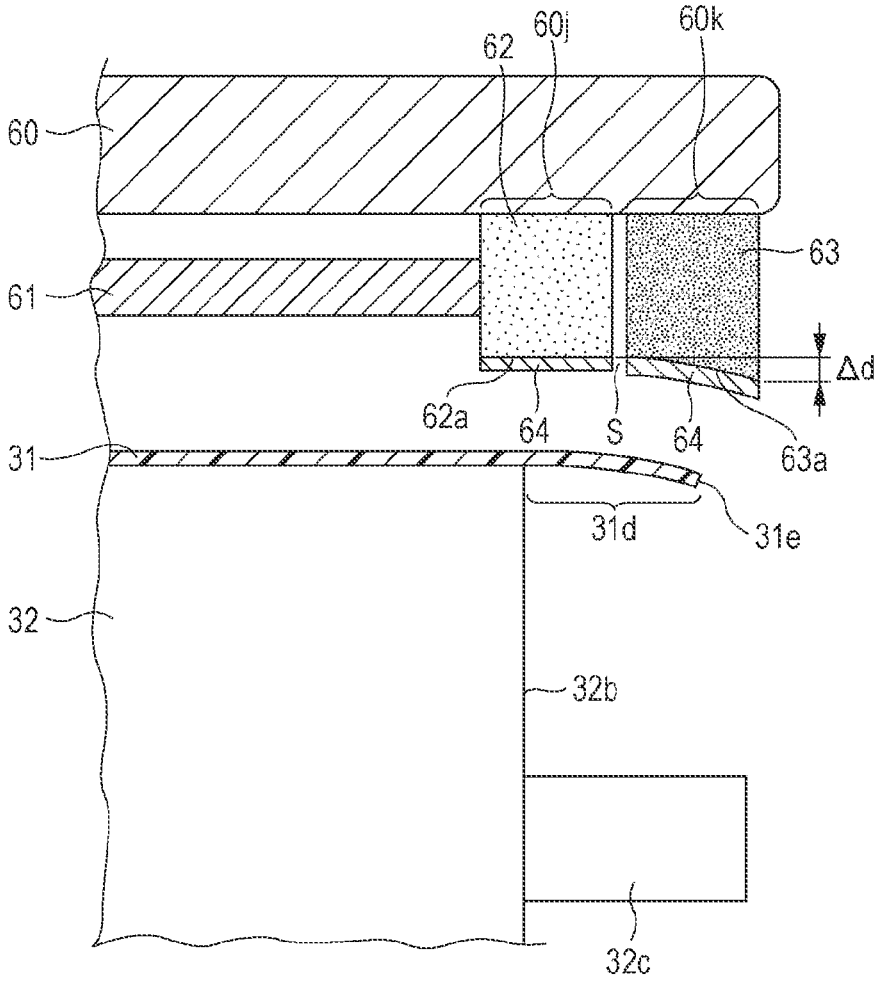
FIG. 9 is a conceptual schematic sectional view illustrating yet another example of a configuration of the hard sealing member when the belt cleaning device is separated from the intermediate transfer belt (detached)
Figure 10:
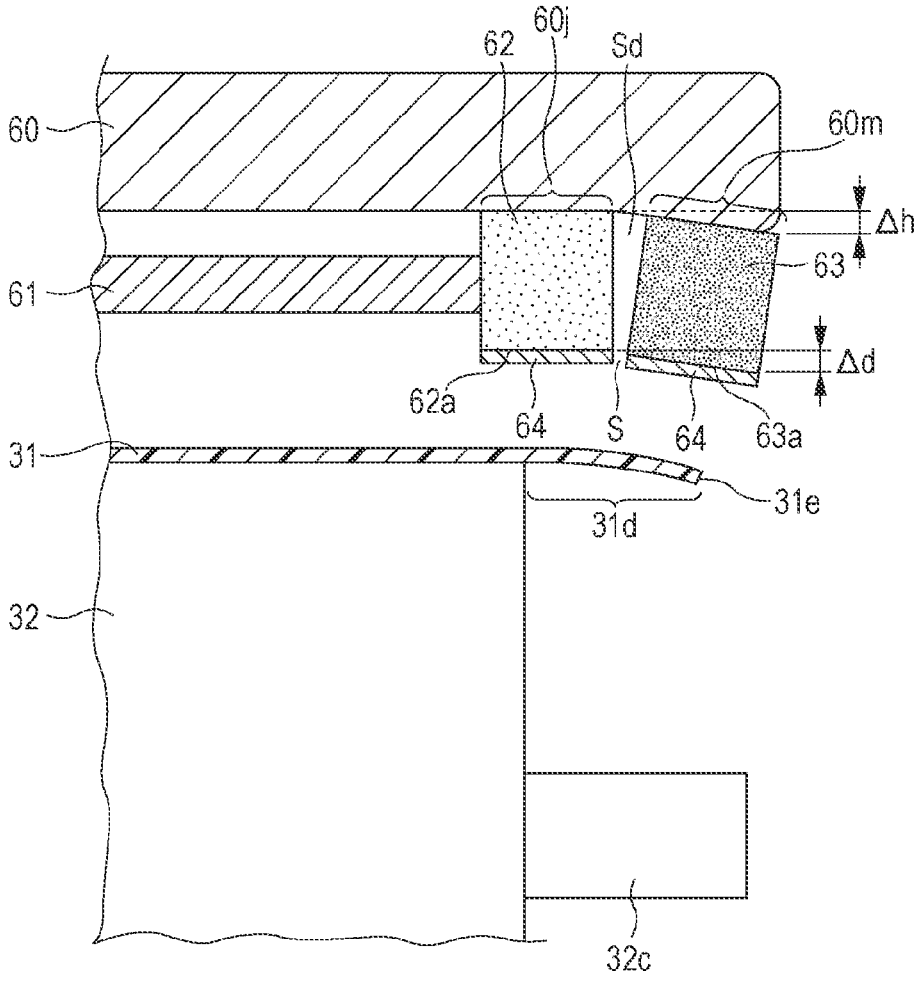
FIG. 10 is a conceptual schematic sectional view illustrating yet another example of a configuration of the hard sealing member (attachment portion of the hard sealing member) when the belt cleaning device is separated from the intermediate transfer belt (detached).

Configurations described below with reference to FIGS. 8 to 10 are applicable to the contact portions 63*a* of the hard sealing members 63 of the belt cleaning device 6 according to the first exemplary embodiment.

Referring to FIG. 8, an example of a configuration of the contact portion 63*a* of the hard sealing member 63 is illustrated. The contact portion 63*a* has a projecting portion that projects further toward the intermediate transfer belt 31 than the contact portion 62*a* of the soft sealing members 62 by a thickness of Δd. The projecting portion is formed over the entirety of the contact portion 63*a*. The contact portion 63*a* of the hard sealing member 63 having such a projecting portion is adopted to obtain the cleaning performance by facilitating contact of the contact portion 63*a* of the hard sealing member 63 with the belt end portion 31*d* deformed as follows: the intermediate transfer belt 31 is looped over the plural support rollers 32 to 35 with tension applied thereto. Thus, from a stage before the belt cleaning device 6 is attached, the belt end portion 31*d* is bent toward the rotational shaft portion 32*c* of the support roller 32 so as to have an embowed shape (see, for example, FIG. 8). The contact portion 63*a* of the hard sealing member 63 illustrated in FIG. 8 follows the deformed shape of the end portion 31*d* of the intermediate transfer belt 31 bent to have the embowed shape as described above even slightly so as to facilitate contact of the contact portion 63*a* with the end portion 31*d*. Thus, toner and the like adhering to the belt end portion 31*d* may be removed.

Referring to FIG. 9, an example of a configuration of the contact portion 63*a* of the hard sealing member 63 is illustrated. The contact portion 63*a* has a projecting portion that, compared to the contact portion 62*a* of the soft sealing members 62, gradually projects toward the intermediate transfer belt 31 as the distance from the soft sealing member 62 increases (portion inclined so that the difference in thickness is Δd at a position most distance from the contact portion 62*a*). The contact portion 63*a* of the hard sealing member 63 illustrated in FIG. 9 substantially follows the deformed shape of the end portion 31*d* of the intermediate transfer belt 31 bent to have the embowed shape as described above so as to facilitate contact of the contact portion 63*a* with the end portion 31*d*. Thus, toner and the like adhering to the belt end portion 31*d* may be removed.

Referring to FIG. 10, an example of a configuration of the contact portion 63*a* of the hard sealing member 63 is illustrated. The substantially rectangular sectional shape of the hard sealing member 63 (hard elastic body) is not changed. However, an attachment surface of the second attachment portion 60*k* of the housing 60, to which the hard sealing member 63 is attached, has a projecting portion that gradually projects toward the intermediate transfer belt 31 as the distance from the soft sealing member 62 increases (portion inclined so that the difference in thickness is Δh (a value corresponding to, for example, Δd) at a position most distance from the contact portion 62*a*). When the hard sealing member 63 having the substantially rectangular section is secured to an attachment surface of a second attachment portion 60*m* having this attachment surface having the projecting portion, as illustrated in FIG. 10, the contact portion 63*a* of the hard sealing member 63 has a portion that, compared to the contact portion 62*a* of the soft sealing member 62, gradually projects toward the intermediate transfer belt 31 as the distance from the soft sealing member 62 increases.

Thus, the contact portion 63*a* of the hard sealing member 63 configured as illustrated in FIG. 10 substantially follows the deformed shape of the end portion 31*d* of the intermediate transfer belt 31 bent to have the embowed shape as described above so as to facilitate contact of the contact portion 63*a* with the end portion 31*d*. Thus, toner and the like adhering to the belt end portion 31*d* may be removed. In this case, the gap S between the hard sealing member 63 and the soft sealing member 62 may be an increasing gap Sd, the width of which gradually increases as the distance from the second attachment portion 60*m* decreases. Thus, the toner and the like removed from the belt end portion 31*d* with the hard sealing member 63 and the like may be received in the increasing gap Sd. As a result, an increased amount of the toner and the like having been removed may be received.

In addition, although the cleaning assist layers 64 are provided on both the contact portions 62*a* of the soft sealing members 62 and the contact portions 63*a* of the hard sealing members 63 of the belt cleaning device 6 in the example described in the first exemplary embodiment, particularly from the viewpoint of removal of the toner and the like adhering to the end portions 31*d* of the intermediate transfer belt 31, it is sufficient that the cleaning assist layers 64 be provided at least on the contact portions 63*a* of the hard sealing members 63. In the case where the toner capturing performance of the contact portions 63*a* of the hard sealing members 63 and the contact portions 62*a* of the soft sealing members 62 is sufficient, the cleaning assist layers 64 are not necessarily provided on the contact portions 63*a* and the contact portions 62*a*.

Although each of the hard sealing members 63 is spaced apart from a corresponding one of the soft sealing member 62 in the belt cleaning device 6 in the example described in the first exemplary embodiment, the hard sealing member 63 may be disposed so as to be in contact with the soft sealing member 62.

Furthermore, although the belt cleaning device 6 cleans the intermediate transfer belt 31 in the example described in the first exemplary embodiment, the belt cleaning device 6 may clean another belt. For example, the belt cleaning device 6 is applicable to a cleaning device for a belt device including an annular belt, which is supported by a roller and rotated and used with end portions of the belt projecting outward beyond axial end portions of the roller, and the end portions of the belt need to be cleaned so as to remove the toner and the like adhering thereto. Specifically, the belt cleaning device 6 is applicable to a belt cleaning device of a direct-transfer (sheet transport) belt device used in a direct-transfer method in which the recording sheet 9, onto which toner images formed by the image forming devices 2 to be transferred, is transported so as to cause the recording sheet 9 to pass through the transfer unit of the image forming devices 2 to transfer the toner images onto the recording sheet 9.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a housing that has an opening opposite an annular belt, which has an outer circumferential surface, end portions, and side surfaces, and which is supported by a roller having axial end portions and rotated in a rotational direction, the opening being opposite the outer circumferential surface of the belt in an axial direction of the belt;

a plate-shaped cleaning member that has longitudinal end portions, that is attached to the housing so as to close part of the opening, that is in contact with, in the axial direction of the belt, the outer circumferential surface at a portion of the belt supported by the roller, and that removes toner adhering to the outer circumferential surface of the belt;

soft sealing members that are formed of soft elastic bodies and have respective contact portions which are in contact with the outer circumferential surface of the belt and have respective upstream end portions in the rotational direction of the belt, the soft sealing members being secured to the housing so as to be in contact with parts of the respective longitudinal end portions of the cleaning member; and hard sealing members that are secured to the housing so that each of the hard sealing members is arranged side by side with a corresponding one of the soft sealing members on a side opposite to the cleaning member relative to the soft sealing member, the hard sealing members having respective contact portions which have upstream end portions in the rotational direction of the belt and are in contact with the side surfaces and the outer circumferential surface at the end portions of the belt, which project outward beyond the axial end portions of the roller, the hard sealing members being formed of hard elastic bodies harder than the soft elastic bodies.

2. The cleaning device according to claim 1, wherein the contact portions of the soft sealing members are in contact with the outer circumferential surface at the portion of the belt supported by the roller and in the end portions of the belt projecting beyond the axial end portions of the roller.

3. The cleaning device according to claim 1, wherein the contact portion of each of the hard sealing members has a first projecting portion which projects further toward the belt than the contact portion of a corresponding one of the soft sealing members.

4. The cleaning device according to claim 3, wherein, the contact portion of each of the hard sealing members has a second projecting portion, and wherein, compared to a distance between the contact portion of a corresponding one of the soft sealing members and the belt, a distance between the second projecting portion and the belt decreases as a distance from the soft sealing member increases.

5. The cleaning device according to claim 1, wherein cleaning assist layers which assist in capturing the toner are provided in the contact portions of the hard sealing members or the contact portions of the hard sealing members and the contact portions of the soft sealing members.

6. The cleaning device according to claim 1, wherein each of the hard sealing members is spaced apart from a corresponding one of the soft sealing members.

7. The cleaning device according to claim 1, further comprising:

a film member attached to the housing, the film member covering a region extending from an upstream position in the rotational direction of the belt to the upstream end portions of the contact portions of the hard sealing members and the upstream end portions of the contact portions of the soft sealing members in the rotational direction of the belt.

8. An image forming apparatus comprising:

a roller;

an annular belt that is supported by the roller and rotated; and the toner cleaning device according to claim 1.

* * * * *